United States Patent [19]

Dobbs et al.

[11] Patent Number: 4,883,117

[45] Date of Patent: Nov. 28, 1989

[54] SWIRL FLOW HEAT EXCHANGER WITH REVERSE SPIRAL CONFIGURATION

[75] Inventors: Bradley A. Dobbs; David B. Wigmore, both of San Diego, Calif.; Richard E. Niggemann, Rockford, Ill.

[73] Assignee: Sundstrand Corporation, Rockford, Ill.

[21] Appl. No.: 221,803

[22] Filed: Jul. 20, 1988

[51] Int. Cl.[4] ..... F28D 7/02

[52] U.S. Cl. ..... 165/164; 165/156; 165/166

[58] Field of Search ..... 165/164, 166, 165, 80.4, 165/80.5, 156

[56] References Cited

U.S. PATENT DOCUMENTS

| | | | |
|---|---|---|---|
| 3,058,722 | 10/1962 | Rich . | |
| 3,323,587 | 6/1967 | Lowell . | |
| 3,610,331 | 10/1971 | Schreiber . | |
| 3,705,618 | 12/1972 | Jouet et al. . | |
| 3,925,021 | 12/1975 | Yoshino et al. . | |
| 4,099,928 | 7/1978 | Norback . | |
| 4,178,991 | 12/1979 | Bieri . | |
| 4,282,927 | 8/1981 | Simmons . | |
| 4,300,627 | 11/1981 | Cleveland et al. . | |
| 4,352,273 | 10/1982 | Kinsel et al. . | |
| 4,380,912 | 4/1983 | Edwards | 165/156 |
| 4,445,569 | 5/1984 | Saho et al. . | |
| 4,460,388 | 7/1984 | Fukami et al. . | |
| 4,473,111 | 9/1984 | Steeb . | |
| 4,697,427 | 10/1987 | Niggemann et al. . | |
| 4,747,450 | 5/1988 | Ikegame et al. | 165/80.4 X |

*Primary Examiner*—Larry Jones

*Attorney, Agent, or Firm*—William D. Lanyi

[57] ABSTRACT

A heat exchanger is provided with a first conduit which utilizes a reverse spiral concept and a second fluid conduit which directs a fluid in thermal communication with the first conduit. One of the fluid conduits of the heat exchanger is formed with a generally S-shaped portion which creates a reverse spiral configuration and which permits a heat exchanger to take advantage of the spiral conduit design while avoiding the typical disadvantages that are generally experienced with spiral conduit configurations. The reverse spiral concept permits both ends of the reverse spiral tube to be easily accessible from a radially outward direction relative to the spiral configuration.

3 Claims, 8 Drawing Sheets

SWIRL FLOW HEAT EXCHANGER WITH REVERSE SPIRAL CONFIGURATION

BACKGROUND OF THE INVENTION

1. Field of the Invention:

The present invention relates generally to heat exchangers and, more particularly, to heat exchangers which utilize swirl flow fluid passages. Even more specifically, the present invention relates to the use of a swirl flow conduit in which a reverse spiral configuration is used.

2. Description of the Prior Art:

Many different types of apparatus have been developed for the purpose of transferring heat from one fluid to another. Typically, this type of apparatus provides a means for conduction one fluid through a heat exchanger in such a way that it passes in thermal communication with a second fluid which is also conducted through the heat exchanger.

U.S. Pat. No. 4,352,273, which issued on Oct. 5, 1982 to Kinsell et al, describes a fluid conditioning apparatus and system in which a working fluid from an external source which is to be conditioned in heat exchangers and fluid conditioning means is admitted to the passage ways of a heat exchanger and to a bypass around the passage ways of the heat exchanger to provide a fluid from the passage ways in a final condition tempered by the bypass fluid.

U.S. Pat. No. 4,300,627, which issued on Nov. 17, 1981 to Cleveland et al, describes an insulated housing for ceramic heat recuperators in which cross-flow ceramic recuperators are disposed in an assembly in which the ceramic recuperator is held by a metalic housing which is adapted for retrofitting to the metalic fitting of existing furnaces, ovens and preheaters. The assembly is characterized by at least two insulating layers inside the conduit portions leading from the operating hot faces of the ceramic core. This structure increases the operating efficiency of the assembly.

U.S. Pat. No. 4,282,927, which issued on Aug. 11, 1981 to Simmons, describes a multi-pass heat exchange circuit which incorporates a concept for reducing the number of parts in a plate and fin type heat exchanger in which a fluid makes plural passes at least at one level of the heat exchanger. In this device, a single layer of a secondary heat transfer material replaces multiple detail parts of the prior art and is appropriately configured in conjunction with flow divider members to assure continuous fluid flow to and between fluid passes.

U.S. Pat. No. 4,178,991, which issued on Dec. 18, 1979 to Bieri, describes a heat exchanger and a heat exchanger element in which the element is constructed with radially disposed walls so as to sub-divide the element into flow zones with alternating zones carrying first and second heat exchange media. The alternating zones convey the media in opposite directions to carry out the heat exchange operation. The walls may be of flat shape disposed in a radial pattern or may be formed of corrugated plates interspersed between flat walls.

U.S. Pat. No. 4,099,928, which issued on July 11, 1978 to Norback, describes a method of manufacturing a heat exchanger body for recuperative exchangers in which the manufacturing method relates to a heat exchanger body composed of a plurality of facially opposed corrugated rectangular sheets of a deformable material with corrugations in alternate sheets crossing the corrugations in the intervening sheets and forming a series of channels through which two streams of gaseous medium are forced crosswise in heat exchange relationship with one another. The juxtaposed edges of the sheets are displaced so that the edges on the same side of the body are alternately sealed and form openings therebetween for admission of the gaseous media into the channels.

U.S. Pat. No. 3,925,021, which issued on Dec. 9, 1975 to Yoshino et al, describes an apparatus comprising a plurality of chemically treated absorption plates for injurious gases contained in the air. It describes a device for removing acidic and injurious gases such as a sulfur dioxide gas and a hydrogen sulfide gas or acid mist from the air comprising a plurality of absorption plates, spacing means positioned for maintaining the absorption plates apart to form a plurality of layers so as to pass air through the space between the layers.

U.S. Pat. No. 3,705,618, which issued on Dec. 12, 1972 to Jouet et al, describes a heat exchanger of a generally cylindrical shape which includes a structure having at least two chambers being wound on themselves in self-enclosing spirals, baffles forming passage ways through the chambers to facilitate the flow of heat exchanging media through the chambers in alternate centripetal and centrifugal relationship.

U.S. Pat. No. 3,610,331, which issued on Oct. 5, 1971 to Schreiber, describes a heat exchanger which is composed of a plurality of discs arranged adjacent to each other. Each of the discs comprises two complimentary plates which are connected to each other by cementing, welding or the like and when so connected form with each other spiral shaped flow passage means.

U.S. Pat. No. 3,323,587, which issued on June 6, 1967 to Lowell, describes a rolled plates cooler wherein the basic component of the heat exchanger is a plate of an elongated configuration having high heat transfer characteristics. The plate can be formed of two interconnected plate elements or formed from a single plate element and is definedd by end edges and longitudinal edges. Four header tubes are associated with the plate and the transversly disposed thereto.

U.S. Pat. No. 4,460,388, which issued on July 17, 1984 et al, describes a heat exchanger that comprisesan elongated plate folded in corrugated fashion and defining a stack of a number of laminated air passages defined by spacer parallel plane heat transfer faces or plates connected alternately along opposite side edges by narrow partition plates. In alternate air passages, spacer plates are disposed having such a wavy or corrugated configuration as to conduct a first current of air flowing into such alternate passages from one open end thereof to flow out of an open side portion thereof opposite the corresponding partition plate.

U.S. Pat. No. 4,473,111, which issued on Sept. 25, 1984 to Steeb, discloses a heat exchanger which incorporates an improved sandwich type core construction. Passages of one set are interleved with those of another set, using spaced parallel heat transfer plates. Elongated parallel spacers extending in one direction established flow passages of one system while elongated parallel spacers extending in a different direction establish flow passage of a second system between paired plates of the first system.

U.S. Pat. No. 3,058,722, which issued to Rich on Oct. 16, 1962, discloses a heat exchanger which is particularly useful as a condenser or evaporator unit in a mechanical refrigeration system. It comprises a substantially conical coil made of tubing-strip material which may be formed either of parallel strips linearly expanded along restricted zones to form the tubes or, alternatively, by extrusion of any other suitable process. The device has a central vertical tube which is connected by tubing to the inner ends of two tubes which are each arranged in an outward spiral which begins at the vertical header tube in the center of the dual spiral and ends at a header conduit that is disposed radially outward from the centrally disposed vertical header tube. While the structure incorporates a tubular pattern that resembles a reverse spiral structure, it does not direct a fluid flow in a reverse spiral path and, furthermore, the fluid conduits described in the Rich patent are not confined within a generally planar region.

U.S. Pat. No. 4,445,569, which issued on May 1, 1984 to Saho et al, describes a scroll type laminated heat exchanger. The device relates to a laminated heat exchanger having a laminated construction consisting of a plurality of perforated heat tranfer plates and spacer arranged alternatingly, the spacers defining a plurality of fluid passages between respective adjacent heat transfer plate so that heat is exchanged between different fluids flowing in different fluid passages through the heat transfer across the heat transfer plates. The invention is concerned with a heat exchanger of the type described above wherein a plurality of separate scroll passages are formed by the spacer so that local concentration of each fluid in its passage is avoided for the purpose of improving the heat transfer efficiency. This device incorporates fluid passages which are formed between solid portions of a heat transfer plate in which the solid portions are shaped in a reverse spiral configuration. The reverse spiral configuration of solid material defines two distinct fluid passages which are each generally spiral in shape and which are maintained in fluid isolation from each other.

When spiral tubes are used in a heat exchanger and the spiral tubes are confined in a planar region, one end of the tube is typically disposed in an outer position relative to the spiral and the opposite end of the tube is disposed at a position that is centrally located within the spiral configuration. While this type of arrangement provides a generally acceptable heat transfer device, it presents a problem relating to connections between the spiral tube and external devices. This problem becomes especially acute when multiple spiral configuration are interconnected with each of the individual spiral tubes being located in a planar region and the planar regions of the plurality of tubes are arranged in parallel association with each other. This type of configuration usually requires some means by which all of the inner ends of the individual spiral tubes must be connected in the central region of the spiral tubes. This presents a problem relating to the manufacturing technique and the structural design of this type of heat exchanger. A significant manufaturing benifit can be ortained if both ends of the spiral tubes can be disposed at locations that are outward from each of the spiral configurations. This type of arrangement would provide for easier manufacturing of the heat exchanger and would simplify repair.

U.S. Pat. No. 4,697,427, which issued to Niggemann et al on Oct. 6, 1987, describes a forced flow evaporator for unusual gravity conditions. Low efficiency heat transfer in evaporators which are subjected to unusual gravitational conditions is avoided through the use of a spiral evaporator conduit which receives, at an inlet, a vaporizable coolant which is at least partly in a liquid phase. Flow of this coolant through the conduit demists the coolant by centrifuging the liquid phase against a pressure wall of the conduit. Vapor flow induces counterrotating vortices which circulate the liquid phase coolant around the interior of the conduit to wet all surfaces thereof. One embodiment of the evaporator described in the Niggemann et al patent incorporates a spiral tube which is configured to provide both an inlet and an outlet that are both disposed radially outward from the central portion of the spiral configuration. That alternative embodiment incorporates a reversal of the spiral at a region is inwardly disposed within the planar region of the structure.

SUMMARY OF THE INVENTION

A heat exchanger made in accordance with the present invention incorporates a first fluid conduit which has a first end and a second end and which is disposed in a planar region. The first fluid conduit is provided with both a first portion and a second portion with the first portion extending in an inward spiral having a first direction of rotation toward a centrally located first area of the planar region. A second portion of the first fluid conduit is connected in fluid communication with the first portion of the first fluid conduit within the first area described above. The second portion of the first fluid conduit extends in an outward spiral having a second direction of rotation from the first area of the planar region toward a second end of the first fluid conduit. The first and second directions of rotation are opposite to each other, resulting in a reverse spiral configuration, and the first and second portions of the first fluid conduit provide fluid communication between the first and second ends of the fluid conduit. A second fluid conduit is shaped to conduct a flow of fluid in thermal communication with the first fluid conduit.

The first fluid conduit of the present invention is configured in a reverse spiral shape with both first and second ends of the first fluid conduit being disposed in the planar region at positions which are radially outward from the spiral reversal portion of the first fluid conduit. The present invention also provides a means for directing a first fluid toward and into the first end of the first fluid conduit and a means for directing that first fluid out of and away from the second end of the first fluid conduit. Additionally, the present invention provides a means for directing a second fluid toward and into a first end of the second fluid conduit and a means for directing and second fluid out of and away from the second end of the second fluid conduit.

In a heat exchanger made in accordance with the present invention, the heat exchanger comprises a plurality of first fluid conduit assemblies wherein each of the first fluid conduit assemblies comprises a first fluid conduit disposed in a first planar region and having a first end and a second end. A first portion of the first fluid conduit extends in an inward spiral to a first area of the first planar region and a second portion of the first fluid conduit is connected in fluid communication with the first portion of the first fluid conduit and extends in an outward spiral toward the second end of the first fluid conduit. The inward spiral of the first portion of the first fluid conduit and the outward spiral of the second portion of the first fluid conduit extend in opposite rotational directions. The second end of the first fluid conduit is connected in fluid communication with the second portion of the first fluid conduit and the first end of the first fluid conduit is connected in fluid communication with the first portion of the first fluid conduit with both the first and second ends of the first fluid conduit being disposed outwardly from the inward and outward spirals within the first planar region. The present invention also comprises a plurality of second fluid conduit assemblies wherein each of the second fluid conduit assemblies, in turn, comprises a first plate and a second plate with the first and second plates being arranged in parallel association to define a second planar region therebetween. A spacer is disposed between the first and second plates. The spacer defines a plurality of generally parallel channels between the first and second plates. Each of the first planar regions of the plurality of first fluid conduit assemblies is arranged in generally parallel association with a preselected one of said second planar regions of the plurality of second fluid conduit assemblies and each of the first plates of the plurality of second fluid conduit assemblies is connected in thermal communication with a preselected one of the first fluid conduit of the plurality of first fluid conduit assemblies. In addition, a housing structure is disposed around the plurality of first fluid conduit assemblies and the plurality of second fluid conduit assemblies. The housing structure is shaped to provide a first manifold chamber connected in fluid communication with each of the first ends of the first fluid conduits. A second manifold chamber is also formed in the housing structure and is connected in fluid communication with each of the second ends of the first fluid conduits. A third manifold chamber is formed in the housing structure and is connected in fluid communication with a first end of each of the plurality of generally paralled channels that are disposed between each of the first and second plates of the plurality of second fluid conduit assemblies and a fourth manifold chamber is also formed in the housing structure and is connected in fluid communication with a second end of each of the plurality of generally parallel channels between each of the first and second plates of the plurality of second fluid conduit assemblies. In addition, connecting means are provided for connecting the first, second, third and fourth manifold chambers in fluid communication with external fluid conduits.

The present invention therefore provides a heat exchanger in which one of the conduits employs a swirl flow configuration in which a reverse spiral shape is used to permit both ends of the fluid conduit to be located in an easily accessible position outward from the spiral portions of the conduit and within the same planar region as the remaining portions of the spiral shaped conduit.

BRIEF DESCRIPTION OF THE DRAWING

The present invention will be more fully understood from reading the description of the preferred embodiment in conjunction with the drawing, in which.

DESCRIPTION OF THE PREFERRED EMBODIMENT

Figure 1:
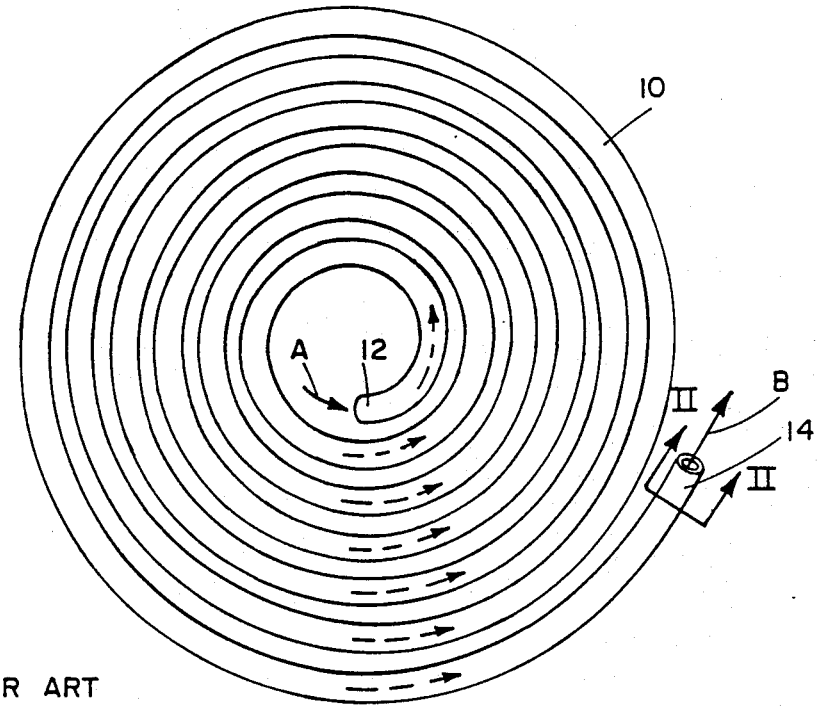
FIG. 1 shows a typical spiral conduit configuration as is generally known to those skilled in the art.

Throughout the description of the preferred embodiment, like reference numerals are used to describe like components.

FIG. 1 illustrates a spiral conduit such as that which is typically used in conjunction with a swirl flow heat exchanger. The spiral conduit 10 has a first end 12 and, in this example, the spiral conduit 10 extends in an outward spiral from the first end 12 to a second end 14. The outward spiral extends in a counter-clockwise direction from a central portion of the configuration to a radially outward position where the second end 14 is located. The configuration illustrated in FIG. 1 is generally known to those skilled in the art and is commonly used in various types of heat exchangers.

Figure 2:
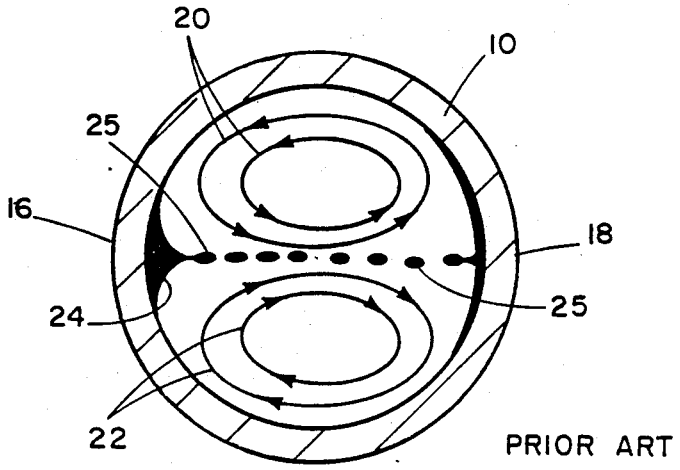
FIG. 2 is a cross-sectional view of a portion of the spiral configuration shown in FIG. 1.

A spiral conduit, such as that illustrated in FIG. 1, is especially suitable in applications in which the fluid passing through the conduit is a two-phase fluid which comprises both liquid and vapor portions. The spiral shaped conduit induces the creation of counter rotating vortices such as those illustrated in FIG. 2 which is a section view of the spiral conduit shown in FIG. 1. In FIG. 2, the conduit 10 is shown in section view with the counter rotating vortices shown within the inner portion of the conduit. Reference numeral 16 illustrates the radially inner portion of the spiral tube and reference numeral 18 illustrates the position of the radially outer portion of the tube. Inside the tube, two vortices, 20 and 22, are formed. These vortices tend to move the liquid portion of the fluid along the inner walls of the conduit 10 in the direction illustrated by the arrows of the vortices. The liquid 24 accumulates proximate the inner portion of the bent spiral configuration of the tube where the two fluid streams meet after passing along the inner surface of the tube. As shown by the schematic droplets 25 in FIG. 2, the liquid then migrates along the diameter of the tube and impinges against the inner surface of the tube proximate the outer region of the spiral, as indicated by reference numeral 18. Therefore, it should be understood that the use of a spiral conduit is especially advantageous when two-phase fluid is to be transmitted through the conduit because of the fact that the counter rotating vortices tend to wipe the inner surface of the conduit. Most particularly, a spiral conduit is advantageous in applications where particles of solid matter, such as ice crystals, can form within the fluid stream. The counter rotating vortices tend to wipe the inner surface of the conduit free of such solid particles and cause the particles to move with the fluid as it passes from one end of the tube to the other.

With reference to FIG. 1, it can be seen that the spiral conduit 10 is disposed in a generally planar region with the second end 14 being disposed at a radially outward position relative to the spiral configuration and the first end 12 being disposed at a radially inward position relative to the spiral configuration. This type of configuration presents a manufacturing problem because of the fact that the first end 12 of the spiral conduit 10 is located at a position within the spiral configuration which may be difficult to reach with external conduits for the purpose of connecting the spiral tube 10 to other devices. This problem becomes especially acute in applications where a plurality of spiral conduits, of the type shown in FIG. 1, are intended to be configured in a parallel arrangement with a spiral tube, such as the conduit 10 shown in FIG. 1, associated with a plurality of similarly shaped conduits with all of their first ends being connected in parallel. This requirement necessitates some type of manifold being disposed proximate the inner portion of the spiral with all of the first ends 12 being connected in fluid communication with that manifold structure. The present invention is intended to provide a heat exchanger conduit which is shaped in such a way that it takes advantage of the fact that spiral conduits form the counter rotating vortices described above, but also in such a way that both ends of the spiral conduit are located at easily accessible positions at the outer portion of the spiral configuration.

Figure 3:
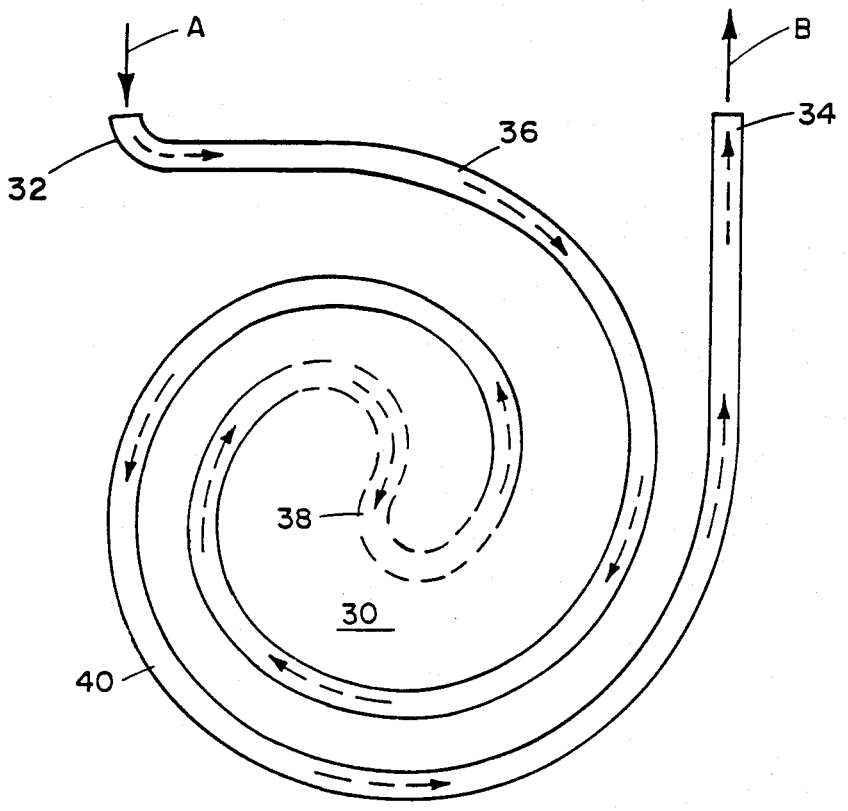
FIG. 3 is a schematic illustration of the reverse spiral concept implemented by the present invention.

FIG. 3 illustrates a spiral conduit 30 made with a reverse spiral shape in accordance with the present invention. The reverse spiral conduit 30 has a first end 32 and a second end 34. The conduit 30 has a first portion 36 which extends in an inward spiral from the first end 32 to a centrally located first area 38. This first portion 36 of the spiral conduit 30 extends from the first end 32 in a clockwise direction toward the first area 38. A second portion 40 of the spiral conduit 30 is connected in fluid communication with the first portion 36 and extends from the first area 38 to the second end 34 of the spiral conduit in an outward spiral that extends in a counter-clockwise direction from the first area 38 to the second end 34. The first area 38 of the spiral conduit 30 is indicated in FIG. 3 by a dashed line. It should be understood that, although indicated by a dashed line, the first area 38 comprises a generally S-shaped portion of the conduit that connects the first portion 36 with the second portion 40. The first portion 36 and the second portion 40 of the spiral conduit 30 are thus connected in fluid communication with each other, by the generally S-shaped portion of the conduit located at the first area 38, and provide fluid communication between the first end 32 and the second end 34 of the spiral conduit 30.

If a fluid is introduced into the first end 32, as indicated by arrow A, it passes through the first portion 36 as indicated by the dashed-line arrows. As it passes through the first portion 36, the fluid continues to flow through the inward spiral toward the first area 38 and, as a result of this passage through the inward spiral, counter rotating vortices are induced to form within the conduit as described above. Eventually, the fluid within the spiral conduit 30 reaches the first area 38 which comprises a generally S-shaped tube that is shown by dashed line in FIG. 3. After passing through the S-shaped tube of the first area 38, the fluid continues its passage through the second portion 40 in an outward spiral as indicated by the dashed-line arrows in a direction that is counter-clockwise and extending toward the second end 34. Eventually, the fluid reaches the second end 34 and passes out of the spiral conduit 30 as indicated by arrow B. It should be understood that, as the fluid passes through the S-shaped first area 38, the counter-rotating vortices formed during its passage through the first portion 36 will be redirected in an opposite direction as the fluid begins its passage through the second portion 40. However, with the possible exception of its travel through the S-shaped conduit located at the first area 38, the fluid is caused to flow in the counter vortical pattern throughout virtually its entire travel through the spirally shaped first 36 and second 40 portions of the conduit 30 from the first end 32 to the second end 34, even though the vortices are reversed in the second portion 40 as compared to the vortices in the first portion 36.

Comparing FIG. 3 to FIG. 1, it should be apparent that the first 32 and second 34 ends of the spiral tube 30 shown in FIG. 3 are both located radially outward from the spiral configuration and the first area 38. In comparison, the spiral conduit 10 shown in FIG. 1 results in the first end 12 being disposed radially inward from the spiral shaped tube. The location of the first 32 and second 34 ends at the positions shown in FIG. 3 is particularly advantageous because it facilitates easy access to both ends of the spiral tube 30 from a position radially outward from the remaining portions of the conduit. The ability to dispose both ends of the spiral conduit 30 at the radially outer positions shown in FIG. 3 is a direct result of the implementation of the reverse spiral concept of the present invention which incorporates the generally S-shaped portion of the structure indicated by dashed line in FIG. 3 at the first area 38 of the structure.

Figure 4:
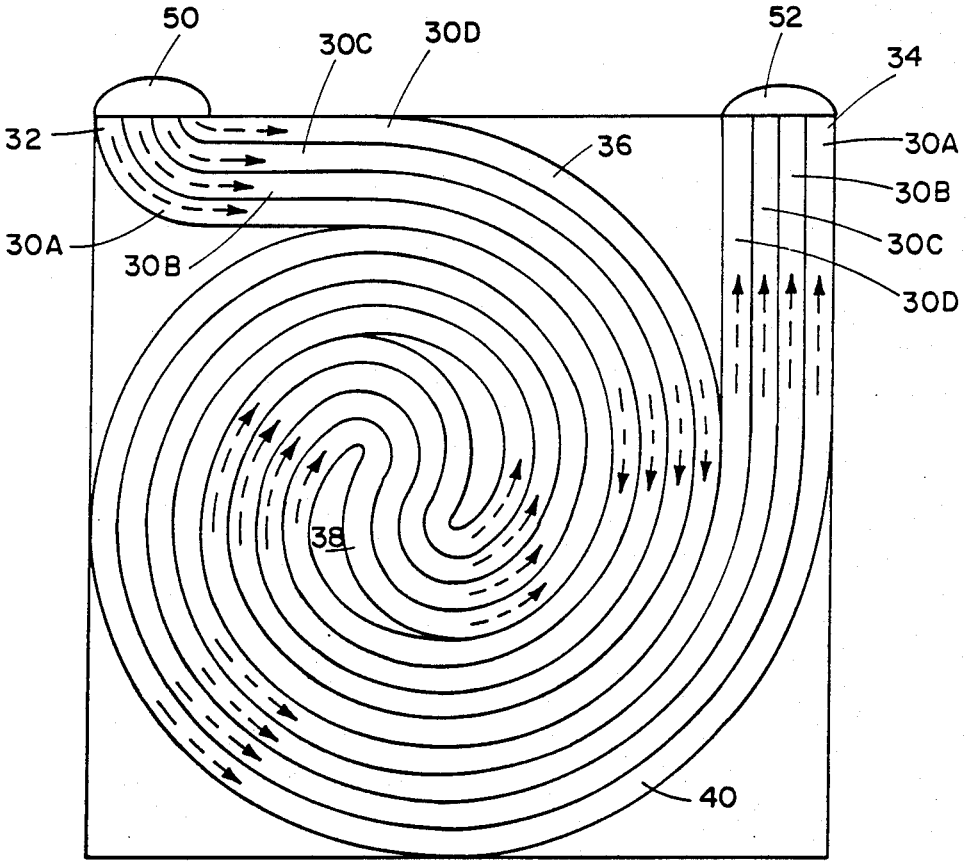
FIG. 4 illustrated a plurality of the reverse spiral conduits, as illustrated in FIG. 3, arranged in parallel association with each other.

FIG. 4 shows four reverse spiral conduits arranged together to form a plural tube heat exchanger in conformance with the preferred embodiment of the present invention. The heat exchanger arrangement shown in FIG. 4 comprises four tubes, 30A, 30B, 30C and 30D, each of which is generally identical in shape to the spiral conduit 30 illustrated in FIG. 3 and described above. The spiral conduits shown in FIG. 4 are arranged in such a way to provide four parallel paths for the fluid flowing from the first end 32 of each of the spiral conduits to the second end 34 of each of the spiral conduits.

Also shown in FIG. 4 is a first manifold chamber 50 and a second manifold chamber 52. The first manifold chamber 50 is connected in fluid communication with the first end 32 of each of the four spiral tubes. The second manifold chamber 52 is connected in fluid communication with the second end 34 of each of the spiral tubes. This type of structure permits a fluid to be directed into the first manifold chamber 50 and pass from the first end 32 of each of the tubes, through the total length of each of the tubes, to the second end 34 of each of the tubes. After exiting from the second end 34 of the tubes, the fluid passes into the second manifold chamber 52. As described above, after passing from the first manifold chamber 50, the fluid passes through a first portion 36 of the spiral tube toward a first area 38 which is similar to the first area 38 shown by dashed line in FIG. 3. The fluid then passes through the second portion 40 of each of the tubes before flowing through the second end 34 and into the second manifold chamber 52.

Figure 5:
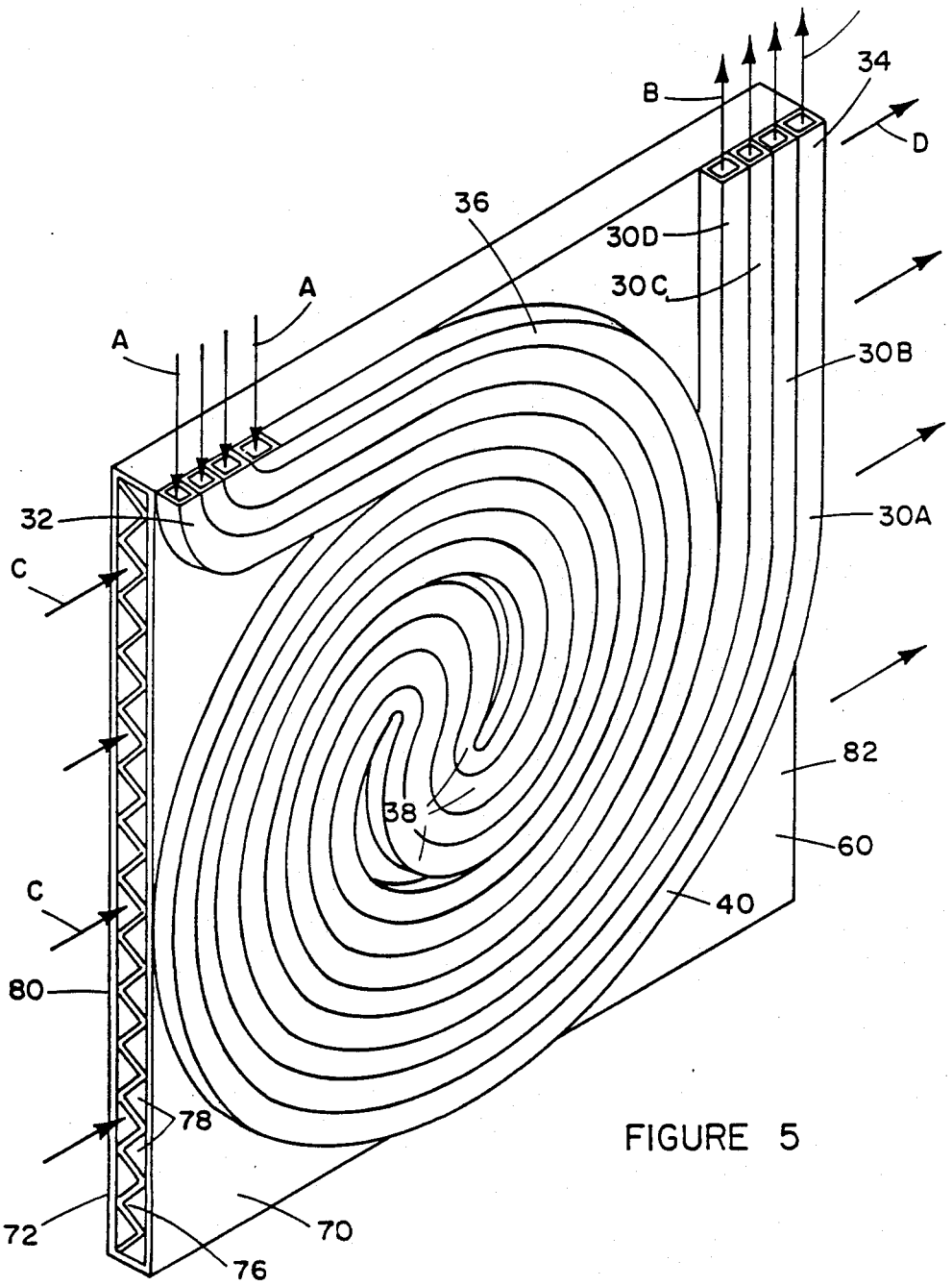
FIG. 5 illustrates a plurality of the reverse spiral conduits, arranged in parallel association, and associated with a second fluid conduit formed by a pair of plates.

FIG. 5 illustrates a heat exchanger assembly 60 made in accordance with the present invention. It comprises a plurality of spiral conduits, 30A, 30B, 30C and 30D, with each of the spiral conduits being provided with a first end 32 and a second end 34 as shown. Each of the spiral conduits illustrated in FIG. 5 is similar in structure and shape to the spiral conduit 30 illustrated in FIG. 3. If a fluid is directed to flow into the first end 32, the fluid will continue to flow through the first portion 36 of each of the four spiral conduits toward the first area 38 where the S-shaped portion of each of the spiral tubes is located. As described above in conjunction with FIG. 3, the fluid flowing from the first end 32 to the first area 38 flows in an inward spiral in a clockwise direction. After passing through the generally S-shaped portion located at the first area 38, the fluid continues to flow through the second portion 40 toward the second end 34 in an outward spiral that extends in a counterclockwise direction. As also shown in FIG. 5, each of the spiral conduits is confined in a planar region with the first area 38 being disposed at a generally central portion of that planar region.

A second fluid conduit is also illustrated in the assembly shown in FIG. 5. It comprises a first plate 70 and a second plate 72 which are disposed in a generally parallel association. The first and second plates, 70 and 72, define a generally planar region therebetween. Within this planar region between the first plate 70 and the second plate 72, a spacer 76 is disposed. The spacer is shaped in such a way so as to form a plurality of channels 78 that extend from a first end 80 of this second conduit formed between the first plate 70 and the second plate 72 to a second end 82 at the opposite end of the second conduit. The channels 78 are generally parallel to each other and define a plurality of fluid passages extending from the first end 80 of the second fluid conduit to the second end 82. Therefore, the second fluid conduit of the present invention is defined between the first plate 70 and the second plate 72 and, furthermore, is divided into a plurality of generally parallel channels 78 which extend from a first end 80 to a second end 82.

The first plate 70 of the second fluid conduit is connected in thermal communication with the first fluid conduit 30, as individually represented by each of the four spiral conduits, 30A, 30B, 30C and 30D, illustrated in FIG. 5. As can be seen in FIG. 5, the first plate 70 is connected in thermal communication with the spiral conduits and, as a result, heat transfer is possible from the fluid passing through the channels 78 to the fluid passing through the spiral conduits or vice versa. If a fluid is introduced, as indicated by arrows C, into the first end 80 of the second fluid conduit, it will pass through the second fluid conduit and exit from the second fluid conduit at the second end 82, as indicated by arrows D. If another fluid is introduced into the first end 32 of the spiral conduits, as indicated by arrows A, it will pass through the reverse spiral shape of the first fluid conduit and exit from the first fluid conduit at the second end 34, as indicated by arrows B. Since the spiral conduits, 30A, 30B, 30C and 30D, are connected in thermal communication with the first plate 70 of the second fluid conduit, an exchange of heat can take place through the walls of the spiral conduits and the material of the first plate 70. Therefore, heat can be transferred between the first fluid and the second fluid.

It should be noted that, since a spiral configuration is especially advantageous when the fluid passing through the conduit is a two-phase fluid, as described above, the present invention is especially advantageous when a heat exchange operation is intended to occur and one of the fluids is expected to be a two-phase fluid. In that circumstance, the two-phase fluid is directed to flow through the reverse spiral conduit and the other, or single phase, fluid is directed to flow through the channels 78 of the second fluid conduit.

Figure 6:
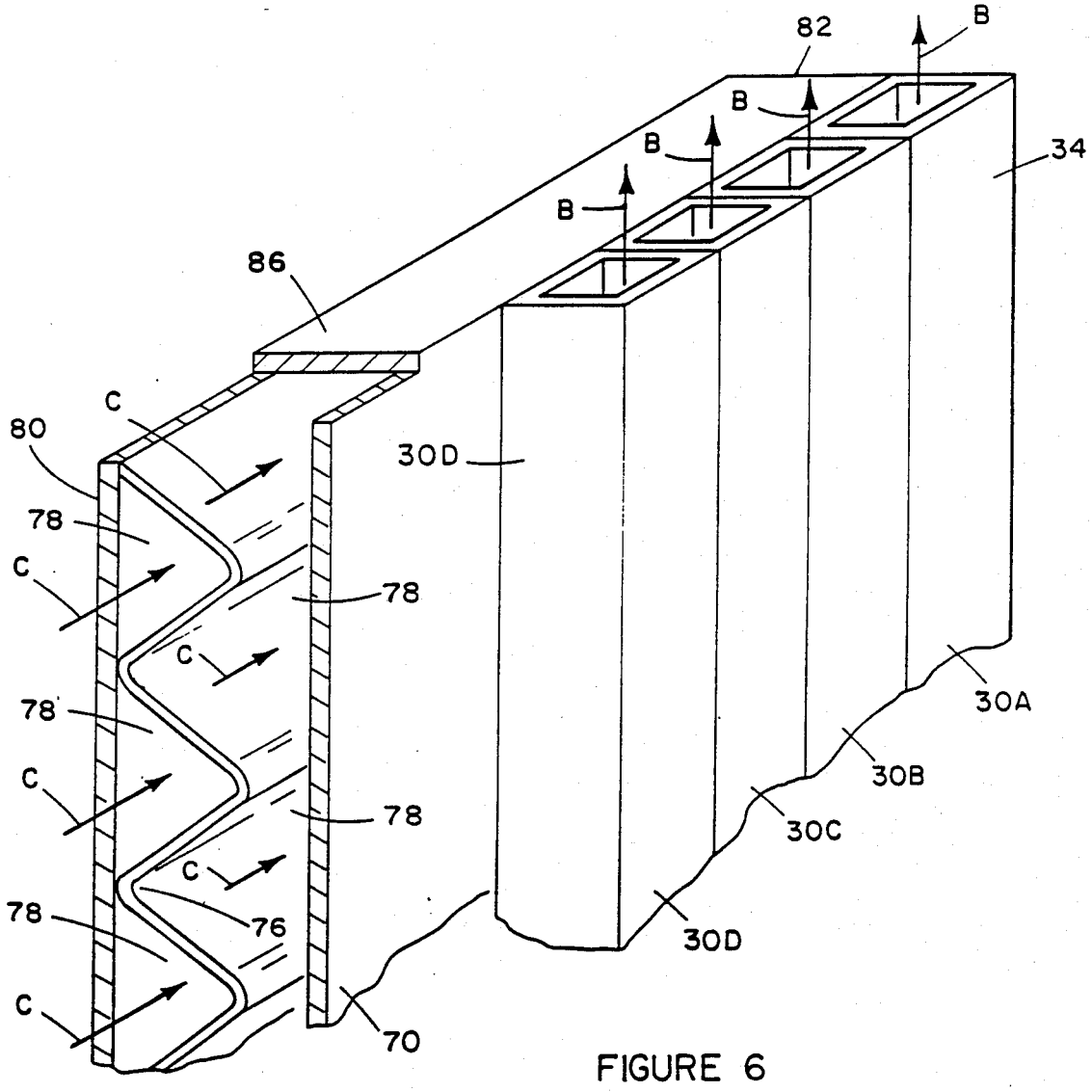
FIG. 6 is a sectional view of the upper-right portion of FIG. 5.

Although the preferred embodiment of the present invention incorporates a plurality of reverse spiral tubes in an assembly such as that illustrated in FIG. 5, it should be understood that the basic principals incorporated in the present invention are as applicable to a single reverse spiral tube as they are to a group of parallel connected reverse spiral tubes such as those shown in FIG. 5. Similarly, the assembly in FIG. 5 illustrates the combination of the reverse spiral tubes and a second fluid conduit that is arranged in thermal communication with the reverse spiral tube. It should be understood that, in a preferred embodiment of the present invention, a plurality of assemblies, such as the single assembly shown in FIG. 5, would be grouped together to improve the overall capacity of a heat exchanger system. FIG. 6 illustrates a sectional view of the upper right portion of the assembly illustrated in FIG. 5. The four reverse spiral conduits, 30A, 30B, 30C and 30D, and more particularly the second end 34 of those reverse spiral conduits, are shown in FIG. 6 with the fluid exiting from the second end 34 as illustrated by arrows B. Also shown in FIG. 6 is the fact that each of the four reverse spiral conduits is connected in thermal communication with the first plate 70.

FIGS. 5 and 6 can each be thought of as illustrating a pair of assemblies in which one of the assemblies comprises the one or more reverse spiral tubes 30 and the other assembly of the pair comprises the first plate 70, the second plate 72 and the spacer 76 disposed therebetween. The assembly of reverse spiral conduits provides a first fluid conduit assembly and the assembly of plates provides a second fluid conduit assembly and, because of the fact that the first plate 70 is connected in thermal communication with each of the reverse spiral tubes of the first fluid conduit assembly, the first and second fluid conduit assemblies are connected in thermal communication with each other.

As shown in FIG. 6, the first plate 70 and the second plate 72 are arranged in a generally parallel association to define a generally planar region therebetween. The combination of the first and second plates therefore defines a second fluid conduit through which the second fluid can pass. Between the first plate 70 and the second plate 72, a spacer 76 is provided which, in turn, defines a plurality of channels 78 that are arranged in a generally parallel configuration and direct the second fluid from a first end 80 of the second fluid conduit to the second end 82. The flow of the second fluid through the channel 78 of the second fluid conduit is illustrated by arrows C in FIG. 6. Because of the connection between the reverse spiral conduits, 30A, 30B, 30C and 30D, and the first plate 70 of the second fluid conduit, a heat exchange relationship is created between the fluid flowing through the channels 78 and the fluid flowing through the reverse spiral conduits, as illustrated by arrows B. FIG. 6 also shows the top portions of the first 70 and second 72 plates being sealed with an additional member 86. It should be understood that the second fluid conduit, located between the first and second plates, could be sealed in the upper region by alternative methods, such as an external housing being disposed in association with the first and second plates in such a way to provide this seal without the requirement of an additional member, such as the member 86, being used to perform this function.

Figure 7:
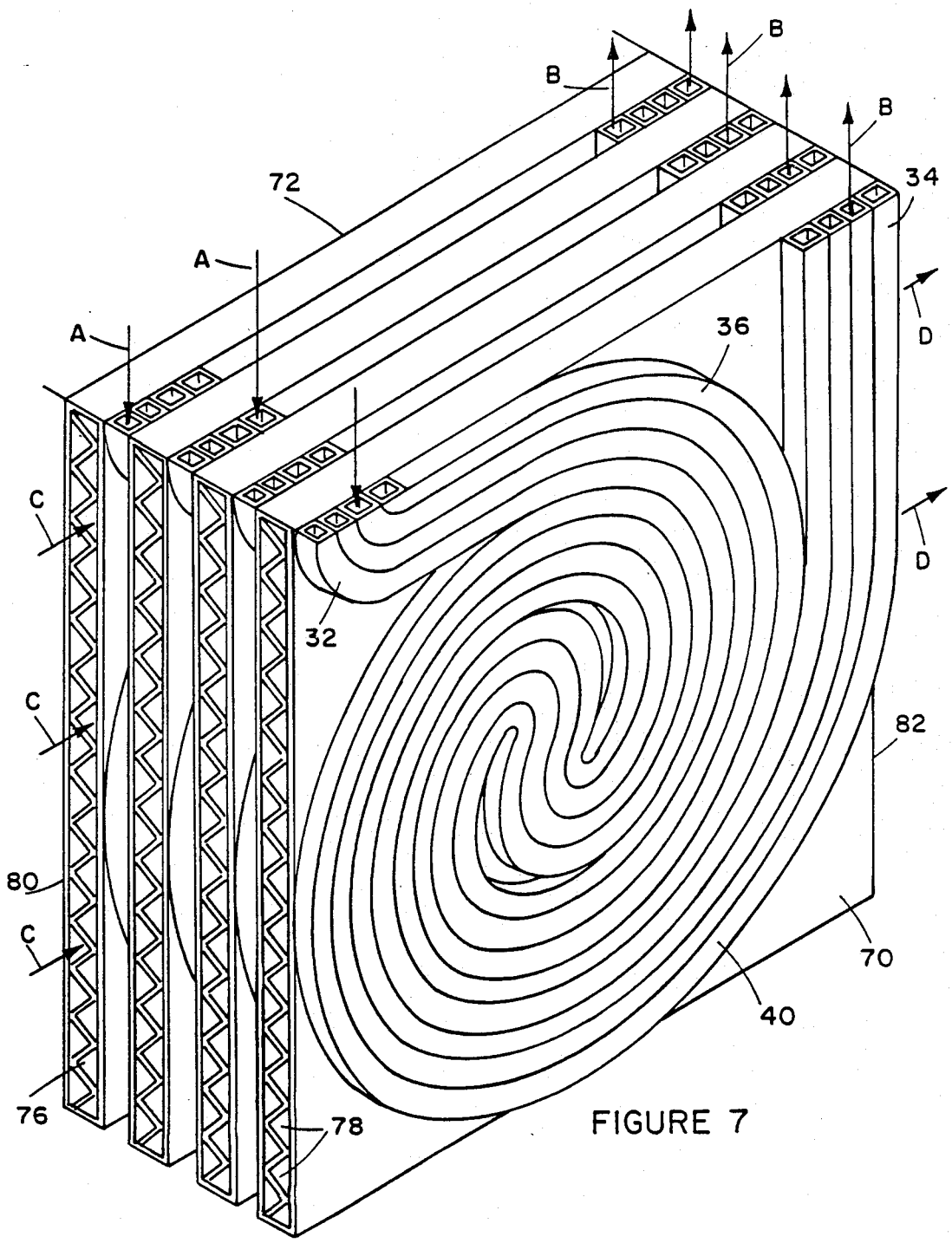
FIG. 7 shows a plurality of the fluid conduit assemblies illustrated in FIG. 5 arranged together in a parallel association.

FIG. 7 illustrates a plurality of the assemblies shown in FIG. 5. Each of the assemblies shown in FIG. 7 comprises one or more reverse spiral conduits, such as that illustrated in FIG. 3, with each of the reverse spiral conduits having a first end 32, a second end 34, a first portion 36 and a second portion 40 as described in detail above. The combination of reverse spiral conduits form the assembly referred to herein as the first fluid conduit assemblies. In addition, FIG. 7 shows a plurality of second fluid conduit assemblies which each comprise a first plate 70, a second plate 72, and a spacer 76 disposed therebetween. The arrangement shown in FIG. 7, which includes a plurality of the assemblies shown in FIG. 5, permits multiple parallel paths for both the first fluid flowing through the reverse spiral conduits and the second fluid flowing between the first and second plates, 70 and 72 respectively. The first fluid enters the first end 32 of each of the reverse spiral tubes, as indicated by arrows A, and continues its inward spiral and outward spiral, as described in detail above, prior to exiting from the second end 34 of the reverse spiral tubes, as indicated by arrows B. The second fluid enters the first end 80 of the second fluid conduit, as indicated by arrows C, and passes through the channels 78 in a direction toward the second end 82 of the second fluid conduit. The second fluid then exits from the second fluid conduit, at its second end 82, as indicated by arrows D. Therefore, it can be seen that a plurality of parallel paths are provided for the second fluid to pass through the second fluid conduit, as indicated by arrows C and D, and a plurality of paths is provided for the first fluid to pass through the plurality of reverse spiral conduits, as indicated by arrows A and B. During the passage of these two fluids through their respective conduits, a heat transfer relationship is created and heat is exchanged between the fluids.

In a preferred embodiment of the present invention, a housing structure 100 is provided to contain the plurality of first and second fluid conduit assemblies described above, as shown in FIG. 8. The housing structure 100 is provided with a first manifold chamber 50 and a second manifold chamber 52 which are connected in fluid communication with the plurality of first ends 32 and second ends 34 of the plurality of reverse spiral conduits, such as those shown in FIG. 4. The housing structure 100 also is provided with a third manifold chamber 102 and a fourth manifold chamber 104 which are, in turn, connected in fluid communication with the first end 80 and second end 82 of the plurality of second fluid conduit assemblies.

Figure 8:
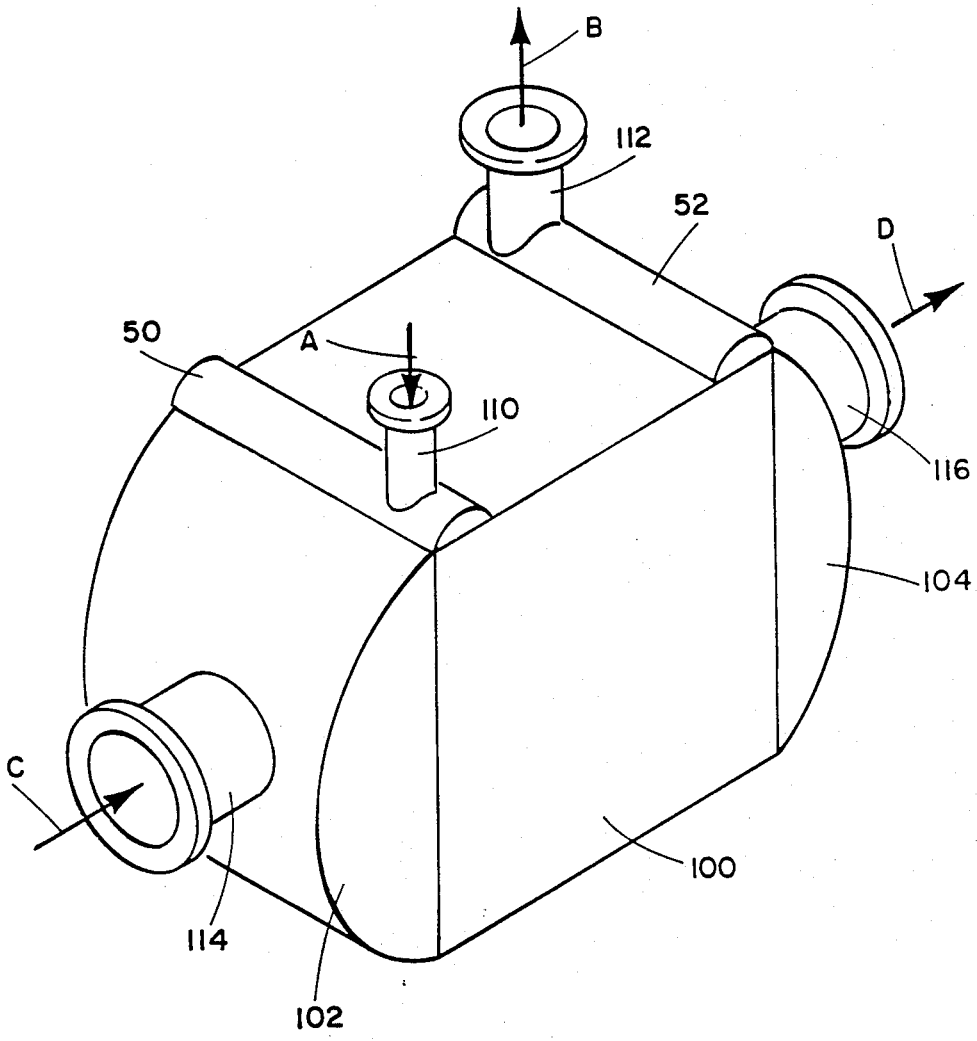
FIG. 8 illustrates a housing structure that is especially adapted to contain a plurality of cooling assemblies made in accordance with the present invention.

Each of the manifold chambers shown in FIG. 8 is additionally provided with a means for connecting the manifold chamber in fluid communication with an external fluid conduit. For example, the first manifold chamber 50 is provided with a means 110 for connecting the first manifold chamber in fluid communication with an external fluid conduit which can be of virtually any configuration, depending on the particular application intended for the heat exchanger shown in FIG. 8. The second manifold chamber 52 is also provided with a second means 112 for connecting it is fluid communication with an external fluid conduit. Similarly, the third manifold chamber 102 is provided with a third means 114 for connecting the third manifold chamber to an external fluid conduit and the fourth manifold chamber 104 is provided with a fourth means 116 for connecting it to an external fluid conduit. By appropriate internal connections between the portions of the housing structure 100 and the portions of the various fluid conduit assemblies disposed within the housing structure, a first fluid can be directed into the first connecting means 110 and the first manifold chamber 50 and into the first end 32 of each of the plurality of reverse spiral conduits which are each constructed in conformance with the illustration shown in FIG. 3. The first fluid then passes through each of the reverse spiral conduits, in a manner described above, and eventually exits from the second end 32 of each of the reverse spiral conduits into the second manifold chamber 52. Since the second connecting means 112 is connected in fluid communication with the second manifold chamber 52, the first fluid can then flow away from the heat exchanger structure shown in FIG. 8. Arrow A indicates the inward flow of the first fluid into the heat exchanger and arrow B indicates the outward flow of the first fluid away from the heat exchanger.

Similarly, a second fluid can enter the heat exchanger, as indicated by arrow C, and flow into the first end 80 of each of the second fluid conduits that are defined between the first 70 and second 72 plates in a manner as described above. After passing through the channels 78 formed by the spacer 76, the second fluid enters the fourth manifold chamber 104 and exits away from the heat exchanger through the fourth connecting means 116. This passage of the second fluid through the heat exchanger is indicated by arrows C and D.

Figure 9:
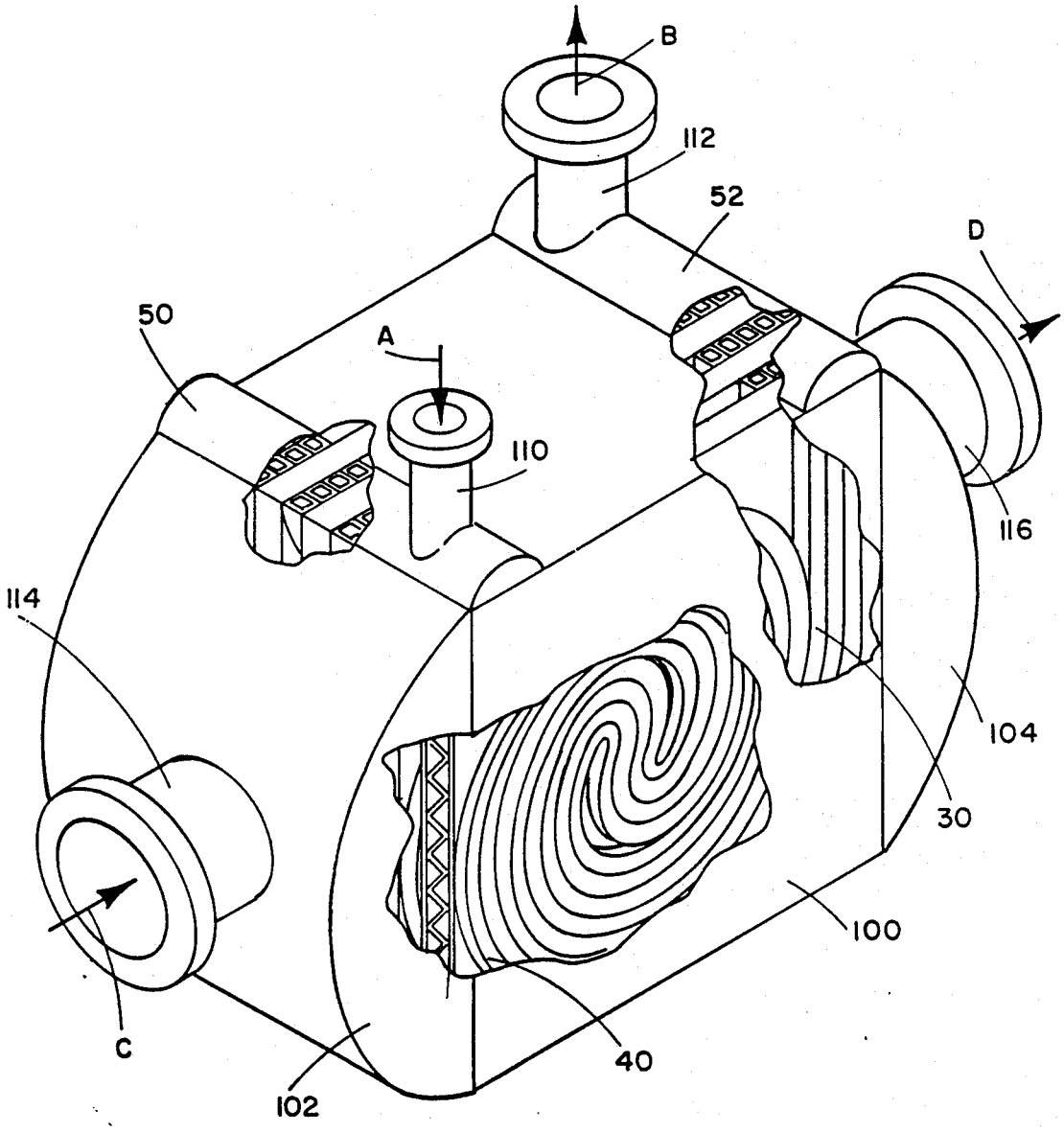
FIG. 9 illustrates the housing structure of FIG. 8 with portions removed to show the plurality of fluid conduit assemblies disposed within the housing structure.

FIG. 9 is an illustration of the heat exchanger made in accordance with the present invention and is generally similar to the illustration of FIG. 8, but with portions of the housing structure 100 removed to illustrate the relationship between the housing structure 100, along with its various manifold chambers, and the plurality of first and second fluid conduit assemblies which are illustrated in FIG. 7. With reference to FIG. 9, the first fluid enters the first connecting means 110, as illustrated by arrow A, and passes into the first manifold chamber 50. Since the first manifold chamber 50 is connected in fluid communication with the first ends 32 of each of the reverse spiral conduits 30, the first fluid then passes through the first portion 36 of each of the first fluid conduits 30 in an inward spiral as indicated by the dashed-line arrows. When the fluid eventually passes into the first area, where the S-shaped portion of the reverse spiral conduit is located, it then begins to pass in an outward spiral through the second portion 40 of the reverse spiral conduit 30 toward the second end 34. It should be notd that, as described above, the inward spiral and the outward spiral are in opposite rotational directions. In this particular example, the inward spiral is in a clockwise direction and the outward spiral is in a counter-clockwise direction, as illustrated in FIG. 9. The first fluid then exits from the reverse spiral conduits 30, at their second ends 34, and enters the second manifold chamber 52 where it flows toward and out of the second connecting means 112. After passing through the second manifold chamber 52 and the second connecting means 112, the first fluid exits from the heat exchanger as indicated by arrow B.

With continued reference to FIG. 9, a second fluid enters the third connecting means 114, as indicated by arrow C, and passes into the third manifold chamber 102 which is connected in fluid communication with the first end 80 of each of the second fluid conduits. As described above, each of the second fluid conduits comprises a first and second plate which are arranged in parallel association with a spacer 76 diposed therebetween. The spacer 76 defines a plurality of channels 78 extending from the first end80 toward the second end 82 of the second fluid conduits. After passing through the plurality of channels 78, the second fluid exits from the second end of the second fluid conduit and passes into the fourth manifold chamber 104. Since the fourth connecting means 116 is connected in fluid communication with the fourth manifold chamber 104, the second fluid can then pass away from the heat exchanger in a direction indicated by arrow D.

With specific reference to FIG. 9, it can be seen that one of the most significant advantages of the present invention is that the first fluid, which passes through the reverse spiral conduits, can be easily accessed from an outward position relative to the spiral configuration of conduits. More specifically, the first manifold 50 and its associated connecting means 110 is disposed at an outward portion of the heat exchanger and the second manifold chamber 52 along with its associated connecting means 112 can also be disposed at an outward position relative to the central portion of the heat exchanger. If the reverse spiral concept of the present invention was not implemented in the heat exchanger shown in FIG. 9, some means would have to be provided to connect external conduits in fluid communication with the internal portion of the spiral tubes. Because of the reverse spiral concept of the present invention, this difficult and complex configuration of fluid connections is not necessary. Therefore, it should be understood that the present invention provides the advantageous characteristics of spiral fluid flow without the inherent difficulties created by the fact that typical spiral conduits must have one end that is located within the internal portion of the spiral structure and, therefore, is difficult to provide external connections to.

Although the present invention has been illustrated with specific detail and has been described with specific reference to the details illustrated in the figures, it should be understood that alternative configurations and embodiments of the present invention are within its scope. More specifically, with reference to FIG. 7, should be noted that the illustration indicates the second fluid entering the first end 80 of the second fluid conduit as indicated by arrow C and passing through the cannel 78 in a direction toward the second end 82 of the second fluid conduit. The second fluid then exits from the second fluid conduit at its second end 82 as indicated by arrow D. However, from the discussion above, it should be apparent that the second fluid conduit could easily be replaced by a reverse spiral conduit similar to the first fluid conduit shown in FIG. 7. This replacement could be achieved by disposing additional reverse spiral conduits in the locations where the spacers 76 and the channels 78 are located in FIG. 7. To facilitate the inlet and outlet of both the first fluid and second fluid, the additional reverse spiral conduits could be disposed in such a way that the inlets and outlets of the added reverse spiral conduits are disposed at the left side of the assembly shown in FIG. 7. With this type of structure, the second fluid would enter one end of the reverse spiral conduits disposed at the bottom portion of the left side of the assembly shown in FIG. 7. This inlet portion of these reverse spiral conduits would be analogous to the first end 32 of the first fluid conduits shown in FIG. 7 and the outlets of the additional reverse spiral conduits would be located at the upper end of the left side of the assembly shown in FIG. 7. With this type of alternate arrangement, the first fluid would enter the first fluid conduits and exit from the first fluid conduits in the way shown in FIG. 7 and the second fluid would enter the additional replacement reverse spiral conduits and exit from those additional replacement reverse spiral conduits at the left side of the assembly shown in FIG. 7. This alternate configuration of the present invention would be especially applicable to the use of two fluids which are both two-phase fluids. In comparison, the assembly shown in FIG. 7 is most applicable when the first fluid is a two-phase fluid and the second fluid is a single phase fluid.

It should also be understood that the conduit used in the reverse spiral configuration shown in FIG. 3 need not be a conduit of constant cross-section. For example, if the conduit shown in FIG. 3 is used as part of an evaporator system, the fluid entering the first end 32 would likely be in the enriched or totally liquid phase and, as heat is provided to the fluid during its passage through the conduit, it would likely exit from the second end 34 as either a vapor or a mixture of liquid and vapor. In other words, referring to FIG. 3, arrow A would represent the entry of essentially a liquid and arrow B would represent the exit of a vapor or a liquid and vapor mixture. In these circumstances, the presence of vapor would represent an expanded volume of the fluid. To accomodate this change in volume of the fluid passing through the conduit, the cross-sectional area of the conduit can be arranged so that the second end 34 of the conduit has a larger cross-sectional area than the first end 32 of the conduit. This tapering of the conduit accommodates the change in volume of the fluid as it passes through the conduit from the first end 32 to the second end 34 as indicated by the arrows in FIG. 3. It should be understood that the use of such a taper in the conduits of the present invention is included within the scope of the description above and the claims. Similarly, the reverse concept would be applicable if the present invention is utilized as a condenser. In other words, a mixture of vapor and liquid entering the first end 32 of the conduit, as indicated by arrow A in FIG. 3, would be condensed at it passes through the conduit in the direction indicated by the arrows in FIG. 3. In this type of application, a larger cross-sectional area would be provided at the first end 32 of the conduit and a smaller cross-sectional area would be provided at the second end 34 of the conduit. This tapering from a large cross-sectional area to a small one would accommodate the decrease in volume inherent in a condenser, wherein a vapor or mixture of vapor and liquid is condensed to a liquid phase as it passes through the heat exchanger.

What we claim is:

1. A heat exchanger, comprising:

a plurality of first fluid conduit assemblies, each of said first fluid conduit assemblies comprising a first fluid conduit disposed in a first generally planar region and having a first end and a second end, a first portion of said first fluid conduit extending in an inward spiral from said first end to a first area of said first generally planar region, a second portion of said first fluid conduit being connected in fluid communication with said first portion of said first fluid conduit and extending in an outward spiral form said first area of said first generally planar region toward sai second end of said first fluid conduit, said inward spiral extending in a rotational direction opposite to the rotational direction of said outward spiral, said second end of said first fluid conduit being connected in fluid communication with said second portion of said first fluid conduit, said first end of said first fluid conduit being connected in fluid communication with said first portion of said first fluid conduit, both said first and second ends of said first fluid conduit being disposed outwardly from said inward and outward spirals and within said first generally planar region; and a plurality of second fluid conduit assemblies, each of said second fluid conduit assemblies comprising a first plate and a second plate, said first and second plates being arranged in parallel association to define a second generally planar region therebetween, a spacer disposed between said first and second plates, said spacer defining a plurality of generally parallel channels within said second generally planar region between said first and second plates, each of said first generally planar regions of said plurality of said first fluid conduit assemblies being arranged in generally parallel association with a preselected one of said second generally planar regions of said plurality of second fluid conduit assemblies, each of said first plates of said plurality of second fluid conduit assemblies being connected in thermal communication with a preselected one of said first fluid conduits of said plurality of first conduit assemblies.

2. The heat exchanger of claim 1, further comprising:

a housing structure disposed around said plurality of first fluid conduit assemblies and said plurality of second fluid conduit assemblies;

a first manifold chamber formed in said housing structure and connected in fluid communication with each of said first ends of said first fluid conduits of said plurality of first fluid conduit assemblies;

a second manifold formed in said housing structure and connected in fluid communication with each of said second ends of said first fluid conduits of said plurality of first fluid conduit assemblies;

a third manifold chamber formed in said housing structure and connected in fluid communication with a first end of each of said plurality of generally parallel channels between each of said first and second plates of said plurality of second fluid conduit assemblies;

a fourth manifold chamber formed in said housing structure and connected in fluid communication with a second end of each of said plurality of generally parallel channels between each of said first and second plates of said plurality of second fluid conduit assemblies;

first means for connecting said first manifold chamber in fluid communication with a first external fluid conduit;

second means for connecting said second manifold chamber in fluid communication with a second external fluid conduit;

third means for connecting said third manifold chamber in fluid communnication with a third external fluid conduit; and fourth means for connecting said fourth manifold chamber in fluid communication with a fourth external fluid conduit.

3. A heat exchanger, comprising:

a plurality of first fluid conduit assemblies, each of said first fluid conduit assemblies comprising a first fluid conduit disposed in a first generally planar region and having a first end and a second end, a first portion of said first fluid conduit extending in an inward spiral from said first end to a first area of said first generally planar region, a second portion of said first fluid conduit being connected in fluid communication with said first portion of said first fluid conduit and extending in an outward spiral from said first area of said first generally planar region toward said second end of said first fluid conduit, said inward spiral extending in a rotational direction opposite to the rotational direction of said outward spiral, said second end of said first fluid conduit being connected in fluid communication with said second portion of said first fluid conduit, said first end of said first fluid conduit being connected in fluid communication with said first portion of said first fluid conduit, both said first and second ends of said first fluid conduit being disposed outwardly. from said inward and outward spirals and within said first generally planar region;

a plurality of second fluid conduit assemblies, each of said second fluid conduit assemblies comprising a first plate and a second plate, said first and second plates being arranged in parallel association to define a second generally planar region therebetween, a spacer disposied between said first and second plates, said spacer defining a plurality of generally parallel channels within said second generally planar region between said first and second plates, each of said first generally planar regions of said plurality of said first fluid conduit assemblies being arranged in generally parallel association with a preselected one of said second generally planar regions of said plurality of second fluid conduit assemblies, each of said first plates of said plurality of second fluid conduit assemblies being connected in thermal communication with a preselected one of said first fluid conduits of said plurality of first fluid conduit assemblies;

a housing structure disposed around said plurality of first fluid conduit assemblies and said plurality of second fluid conduit assemblies;

a first manifold chamber formed in said housing structure and connected in fluid communication with each of said first ends of said first fluid conduits of said plurality of first fluid conduit assemblies;

a second manifold chamber formed in said housing structure and connected in fluid communication with each of said second ends of said first fluid conduits of said plurality of first fluid conduit assemblies;

a third manifold chamber formed in said housing structure and connected in fluid communication with a first end of each of said plurality of generally parallel channels between each of said first and second plates of said plurality of second fluid conduit assemblies;

a fourth manifold chamber formed in said housing structure and connected in fluid communication with a second end of each of said plurality of generally parallel channels between each of said first and second plates of said plurality of second fluid conduit assemblies;

first means for connecting said first manifold chamber in fluid communication with a first external fluid conduit;

second means for connecting said second manifold chamber in fluid communication with a second external fluid conduit;

third means for connecting said third manifold chamber in fluid communication with a third external fluid conduit; and fourth means for connecting said fourth manifold chamber in fluid communication with a fourth external fluid conduit.

* * * * *